US008564500B2

(12) United States Patent
Tanabe et al.

(10) Patent No.: US 8,564,500 B2
(45) Date of Patent: Oct. 22, 2013

(54) SPIRAL ANTENNA

(75) Inventors: Masahiro Tanabe, Kawasaki (JP); Hisamatsu Nakano, Koganei (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 316 days.

(21) Appl. No.: 12/964,034

(22) Filed: Dec. 9, 2010

(65) Prior Publication Data

US 2011/0234471 A1 Sep. 29, 2011

(30) Foreign Application Priority Data

Mar. 29, 2010 (JP) ..... 2010-076044

(51) Int. Cl.
*H01Q 1/36* (2006.01)

(52) U.S. Cl.
USPC ..... 343/895

(58) Field of Classification Search
USPC ..... 343/700 MS, 792.5, 895
See application file for complete search history.

(56) References Cited

U.S. PATENT DOCUMENTS 3,555,554 A * 1/1971 Kuo ..... 343/895
5,313,216 A * 5/1994 Wang et al. ..... 343/700 MS

FOREIGN PATENT DOCUMENTS

| | | |
|---|---|---|
| JP | 6-152225 | 5/1994 |
| JP | 11-163622 | 6/1999 |
| JP | 2000-252738 | 9/2000 |
| WO | WO 02/29928 A2 | 4/2002 |
| WO | WO 02/29928 A3 | 4/2002 |

OTHER PUBLICATIONS

Johnson J. H. Wang, et al., "Design of Multioctave Spiral-Mode Microstrip Antennas", IEEE Transactions on Antennas and Propagation, vol. 39, No. 3, Mar. 1991, pp. 332-335.
Extended Search Report issued Jul. 15, 2011 in Europe Application No. 10252152.3.
Julius A. Kaiser, "The archimedean Two-Wire Spiral Antenna", IRE Transactions on Antennas and Propagation, IEEE, vol. 10, No. 3, XP011220801, May 1, 1960, pp. 312-323.
H. Nakano, et al., "Cavity-backed Archimedean spiral antenna with strip absorber", IET Microwaves Antennas & Propagation, vol. 2, No. 7, XP006031884, Oct. 6, 2008, pp. 725-730.

* cited by examiner

*Primary Examiner* — Tan Ho
(74) *Attorney, Agent, or Firm* — Oblon, Spivak, McClelland, Maier & Neustadt, L.L.P.

(57) ABSTRACT

According to one embodiment, a spiral antenna includes an antenna element, a cavity, and a radio wave absorber. The spiral antenna is formed into a spiral shape on a dielectric substrate. The cavity is formed to have a space with the antenna element. The radio wave absorber is placed to cover a terminal end portion of the spiral.

4 Claims, 8 Drawing Sheets

SPIRAL ANTENNA

CROSS-REFERENCE TO RELATED APPLICATIONS

This application is based upon and claims the benefit of priority from Japanese Patent Application No. 2010-076044, filed Mar. 29, 2010 the entire contents of which are incorporated herein by reference.

FIELD

Embodiments described herein relate generally to a spiral antenna having a wideband characteristic.

BACKGROUND

In a spiral antenna that radiates electromagnetic waves in the forward direction, a wideband characteristic and low profile are achieved by inserting a radio wave absorptive material into a space between the antenna and a cavity (see, e.g., Jpn. Pat. Appln. KOKAI Publication No. 2000-252738).

If the lower limit of the operating frequency is lowered, however, the space between the cavity and spiral antenna physically widens, so the amount of radio wave absorptive material to be used increases. This makes it difficult to decrease the weight of the antenna.

DETAILED DESCRIPTION

In general, according to one embodiment, a spiral antenna includes an antenna element, a cavity, and a radio wave absorber. The spiral antenna is formed into a spiral shape on a dielectric substrate. The cavity is formed to have a space with the antenna element. The radio wave absorber is placed to cover a terminal end portion of the spiral.

Embodiments will be explained in detail below with reference to the accompanying drawing.

Figure 1:
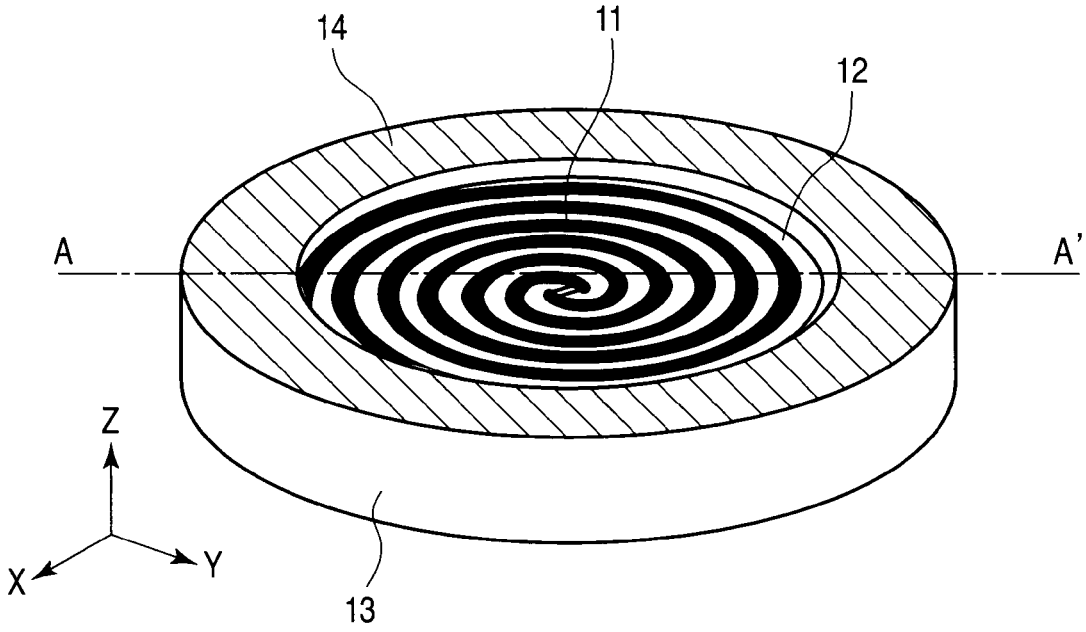
FIG. 1 is a perspective view showing the outer shape of a spiral antenna according to an embodiment.
Figure 2:
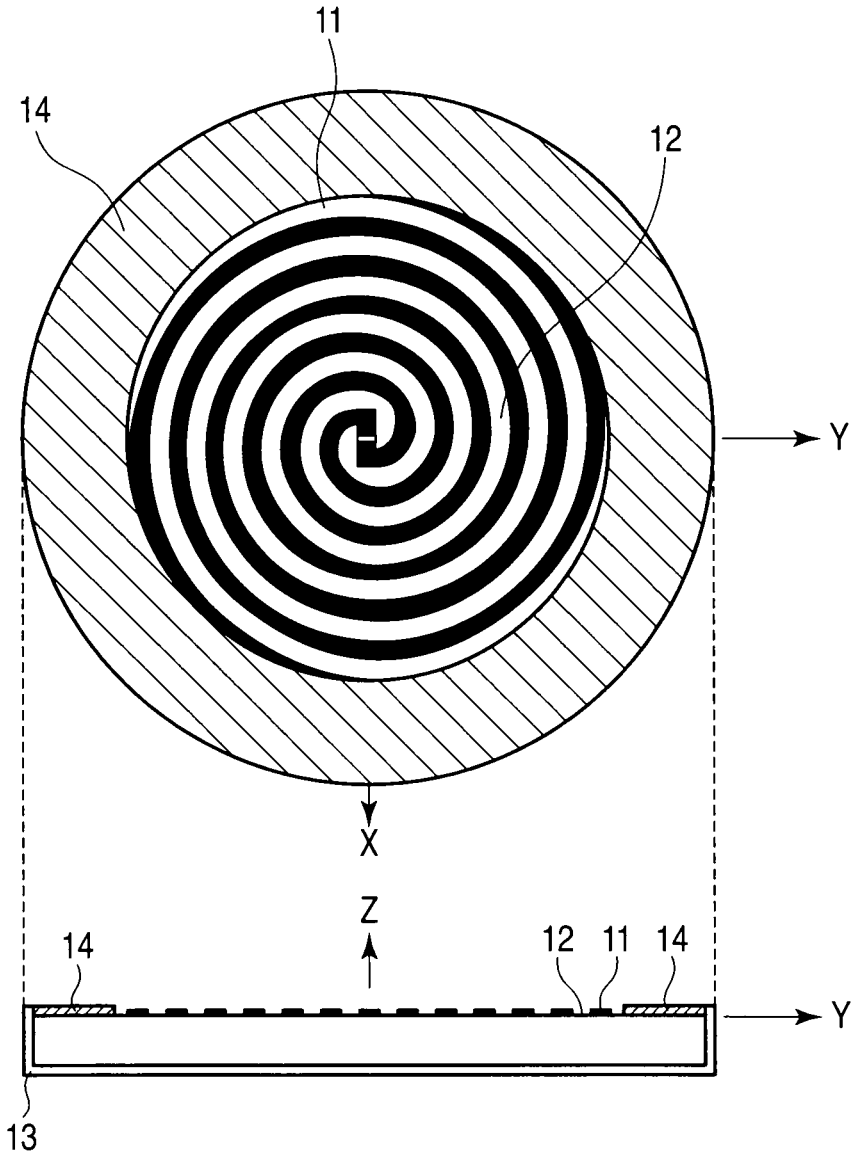
FIG. 2 is a view showing section A-A' of the spiral antenna shown in FIG. 1.

FIG. 1 is a perspective view of the outer shape of an antenna according to an embodiment of the present embodiment. FIG. 2 is a sectional view showing section A-A' of the antenna shown in FIG. 1.

This spiral antenna includes an antenna element 11 formed into spiral patterns on a dielectric substrate 12, a metal cavity 13 for supporting the dielectric substrate 12 so as to form a predetermined space with the antenna element 11, and a radio wave absorber 14 formed to cover the terminal end portions of the spirals of the antenna element 11. For example, the radio wave absorber 14 is formed into a ring shape so as to be brought into contact with the cavity 13, and placed on the upper surface of the dielectric substrate 12 so as to cover the terminal end portions of the spirals of the antenna element 11 from above.

The operation of the spiral antenna having the structure as described above will be explained below.

The operation principle of the spiral antenna can be explained by the band theory. That is, radiation occurs from the antenna in a region (one-wavelength circumference) where the wavelength corresponding to the operating frequency and the outer periphery of the antenna are equal. Accordingly, if the outermost periphery of the spiral antenna is smaller than the one-wavelength circumference at the lower-limit operating frequency, no radiation occurs from the spiral antenna at the frequency, and a current flowing through a spiral arm is reflected by the terminal end portion of the spiral arm, thereby deteriorating the characteristics. As a technique of suppressing this reflected wave, a method of spreading a radio wave absorber between the spiral antenna and cavity is generally used. However, this method poses the problem of the increase in weight.

Figure 3:
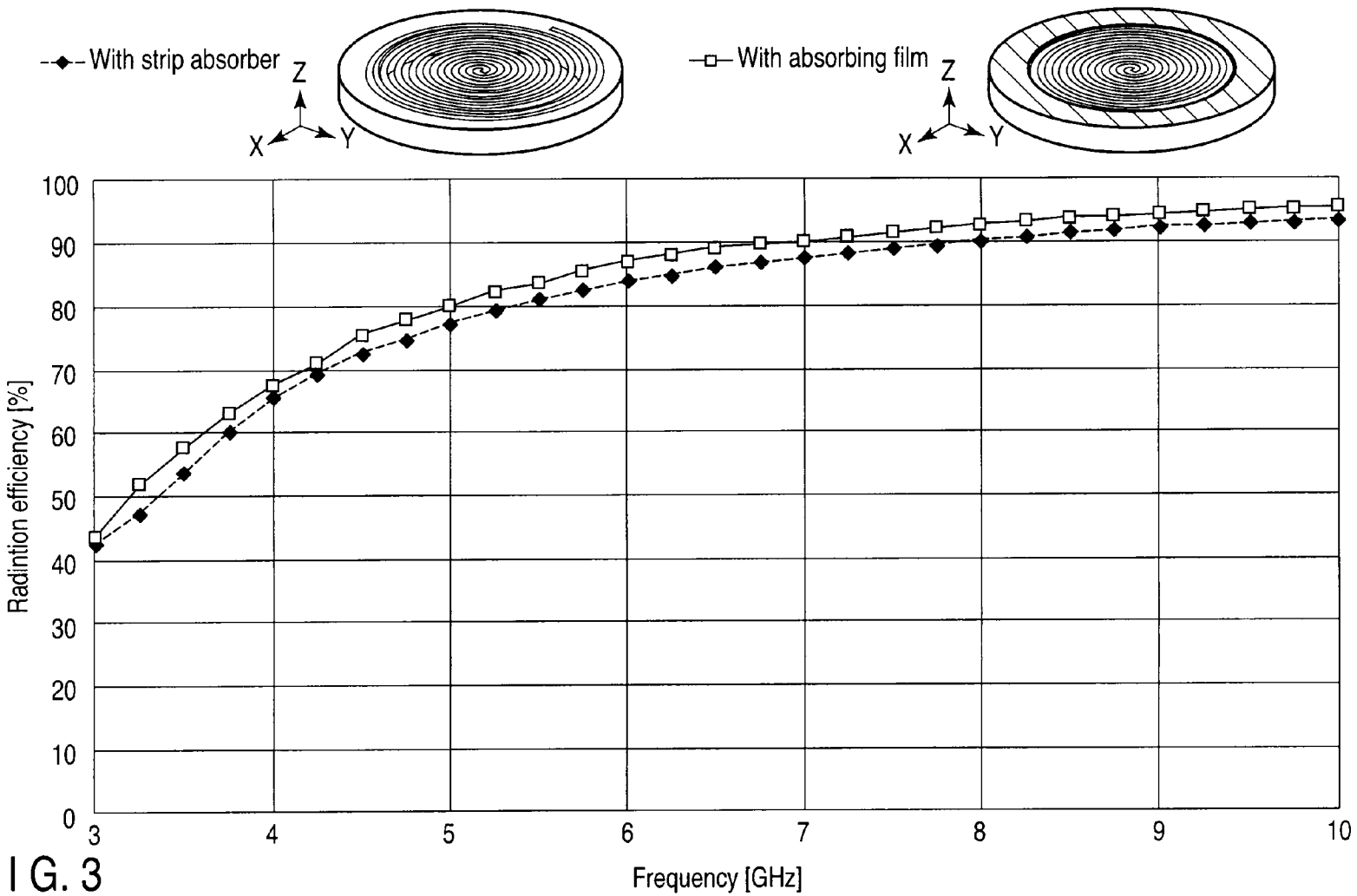
FIG. 3 is a graph showing the radiation efficiency of the spiral antenna according to the embodiment.
Figure 4:
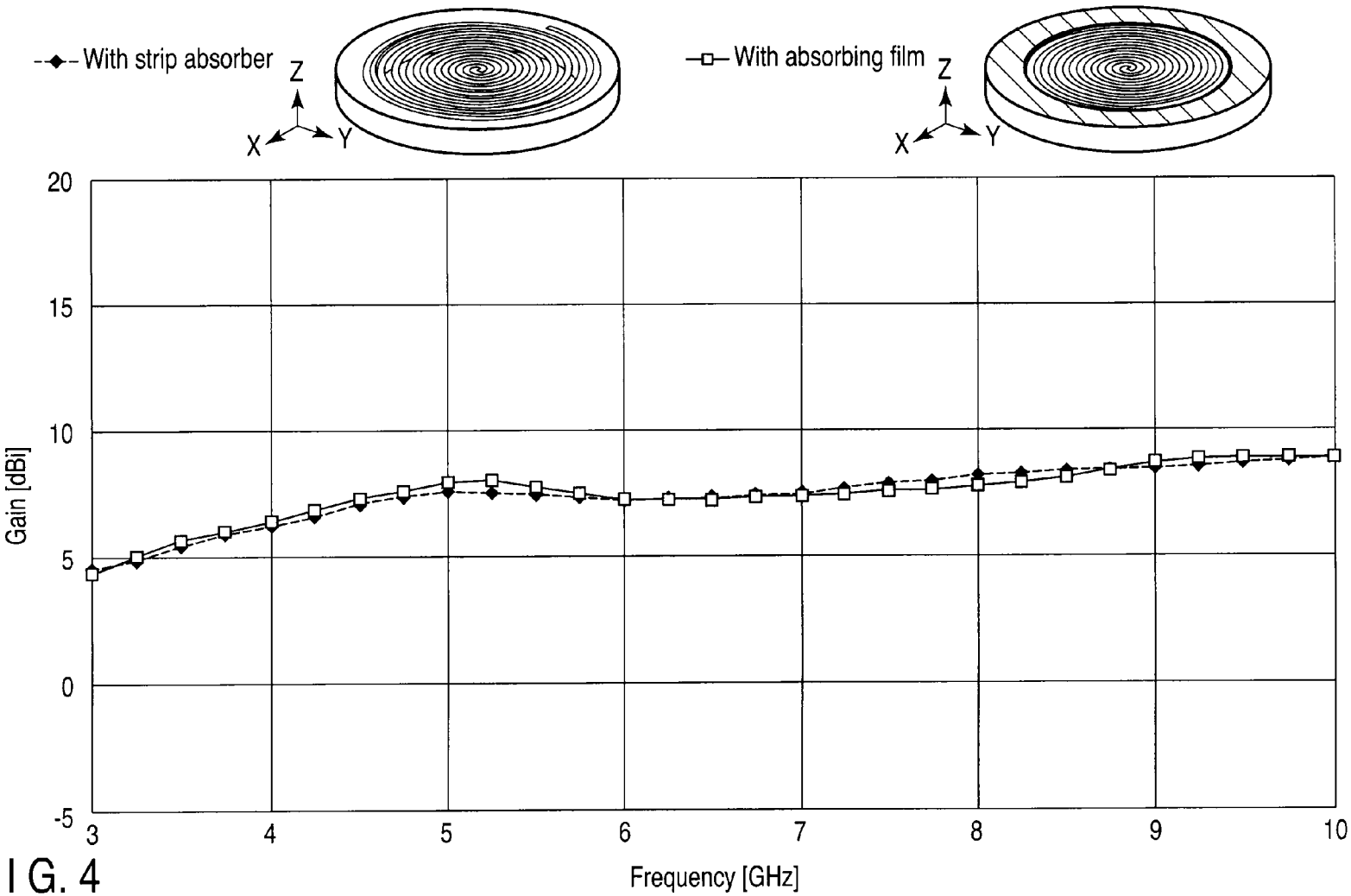
FIG. 4 is a graph showing the gain of the spiral antenna according to the embodiment.
Figure 5:
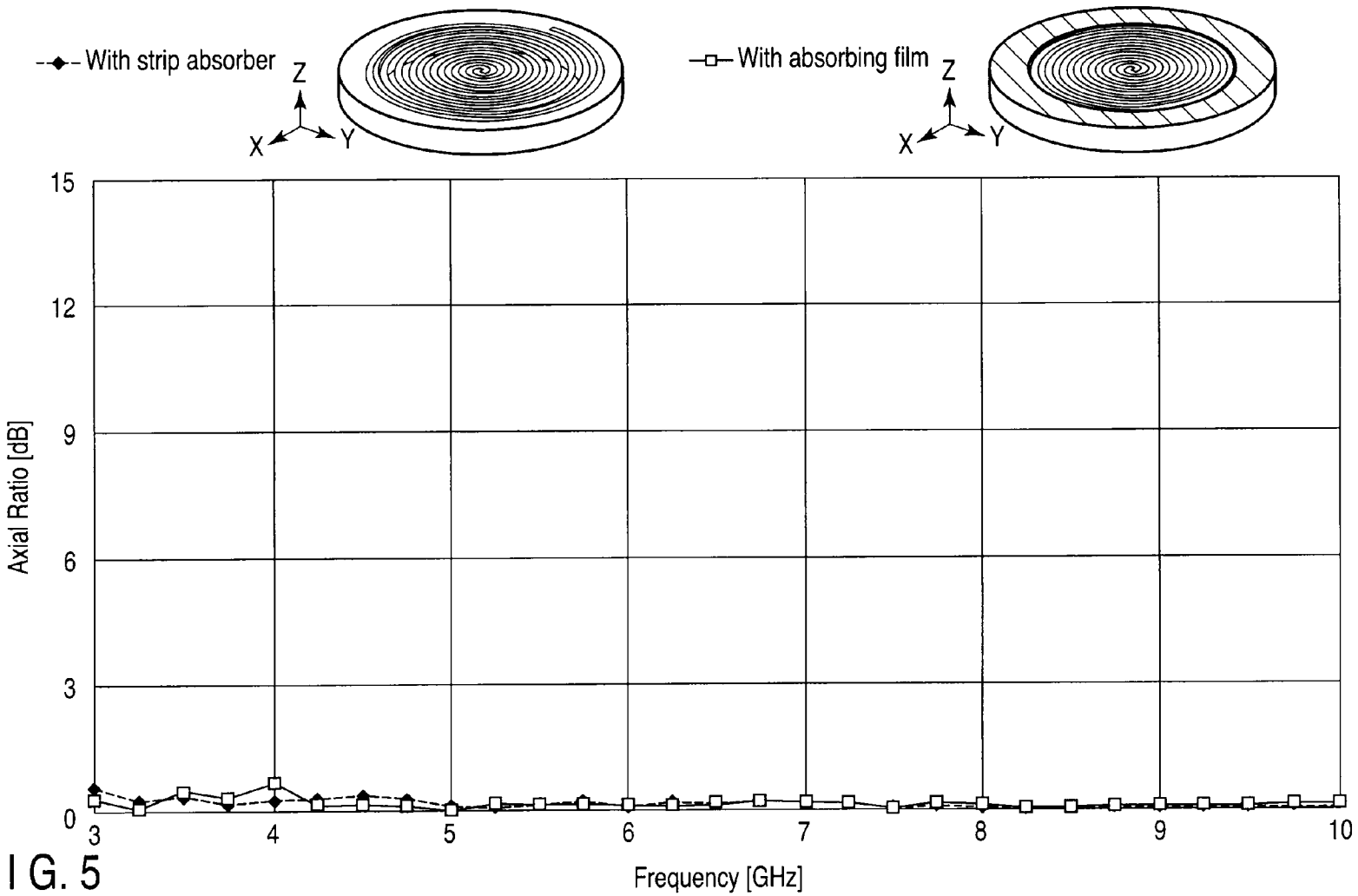
FIG. 5 is a graph showing the axial ratio of the spiral antenna according to the embodiment.

FIG. 3 shows the frequency responses of the radiation efficiency in the positive Z-axial direction. The abscissa represents the frequency [GHz], and the ordinate represents the radiation efficiency [%]. The broken line represents a simulation result when a radio wave absorber is spread between the spiral antenna and cavity. The solid line represents a simulation result when a thin radio wave absorber such as a film is placed on the spiral arms as in this embodiment. FIG. 4 shows the frequency responses of the gain in the positive Z-axial direction in the simulations shown in FIG. 3. The abscissa represents the frequency [GHz], and the ordinate represents the absolute gain [dBi]. FIG. 5 shows the frequency responses of the axial ratio in the positive Z-axial direction in the simulations shown in FIG. 3. The abscissa represents the frequency [GHz], and the ordinate represents the axial ratio [dB].

As shown in FIGS. 4 and 5, the gain and axial ratio remain almost the same even when the radio wave absorber is placed on the spiral arms as in this embodiment. In addition, when the radio wave absorber is placed on the spiral antenna, the placement region can be made smaller than that when the radio wave absorber is placed between the spiral antenna and cavity. That is, since the amount of radio wave absorber usage decreases, the radiated energy increases. This helps increase the antenna efficiency.

In the embodiment as described above, the radio wave absorber is formed to cover the terminal end portions of the spiral antenna. This makes it possible to increase the antenna efficiency while ensuring the wideband characteristic and low profile.

Modifications

Figure 6:
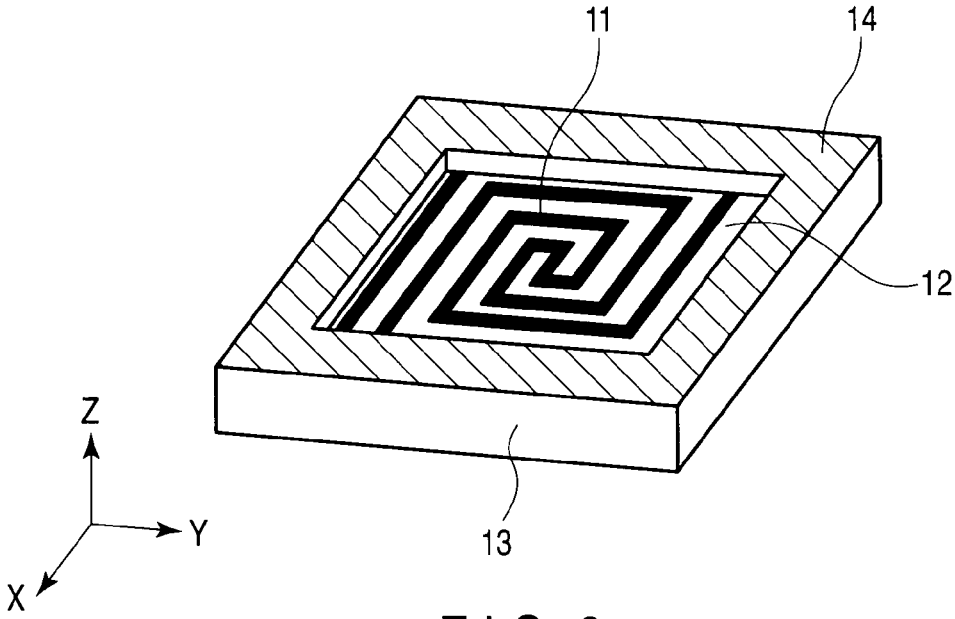
FIG. 6 is a perspective view showing an antenna structure when the spiral shape is a square.

Note that the present embodiment is not directly limited to the above-mentioned embodiment. For example, the following modifications are possible. The spiral antenna is circular in the above embodiment, but the shape need not be a circle. For example, as shown in FIG. 6, the same effect is obtained even when the spiral shape is a polygon such as a square.

Figure 7:
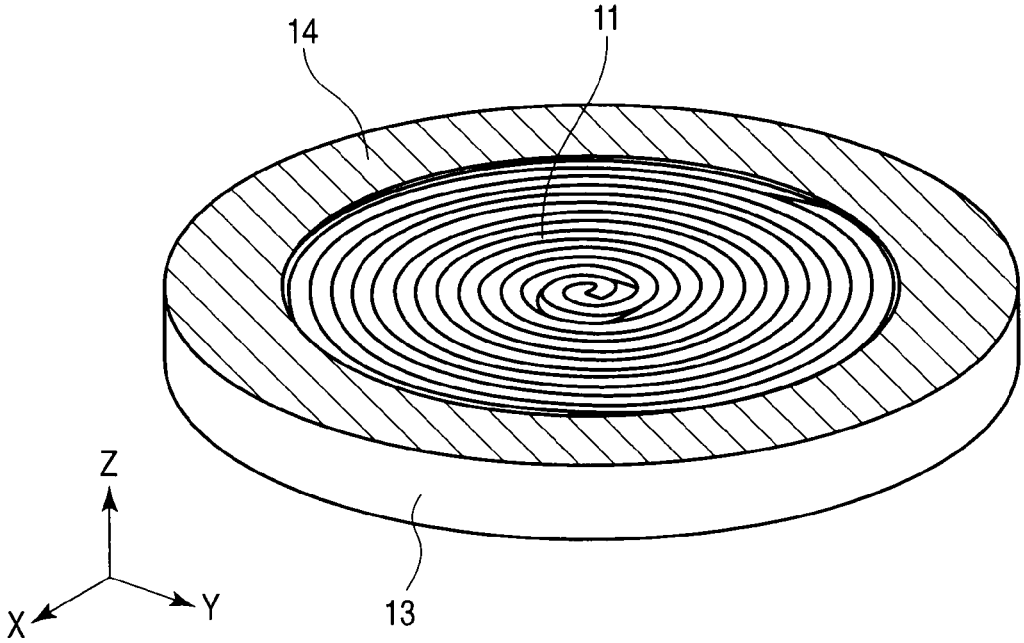
FIG. 7 is a perspective view showing an antenna structure using a single-fed spiral antenna.
Figure 8:
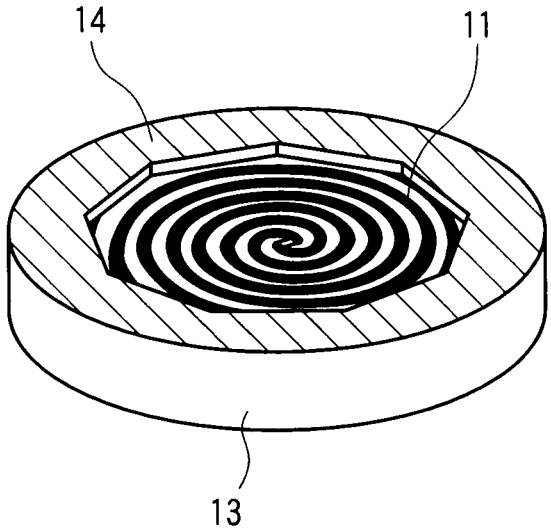
FIG. 8 is a perspective view showing an antenna structure when a radio wave absorber has a polygonal shape.
Figure 9:
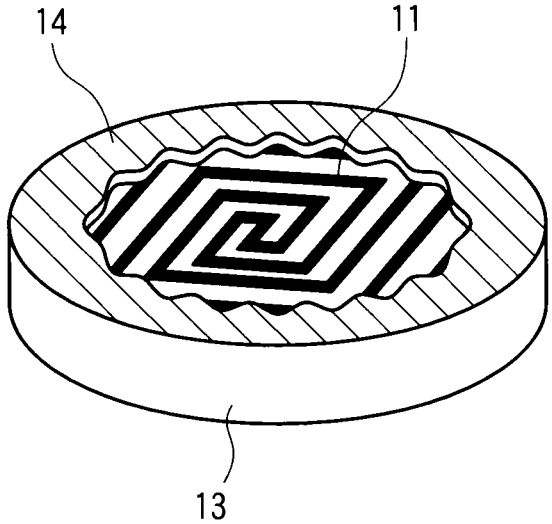
FIG. 9 is a perspective view showing an antenna structure when the radio wave absorber has a wavy shape.
Figure 10:
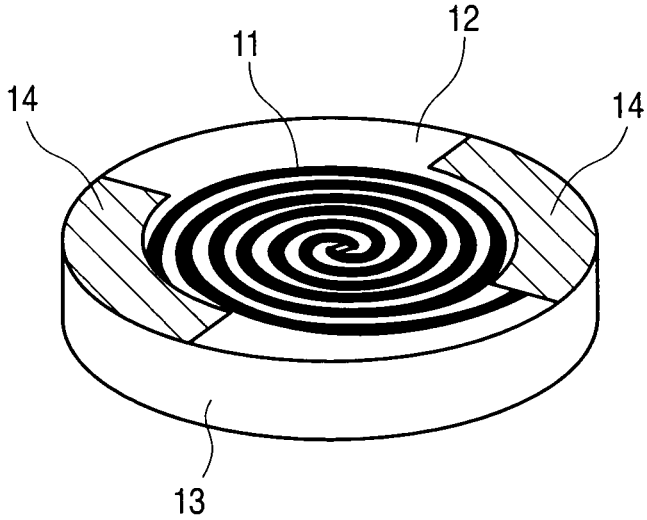
FIG. 10 is a perspective view showing an antenna structure when radio wave absorbers are arranged in portions of the periphery.
Figure 11:
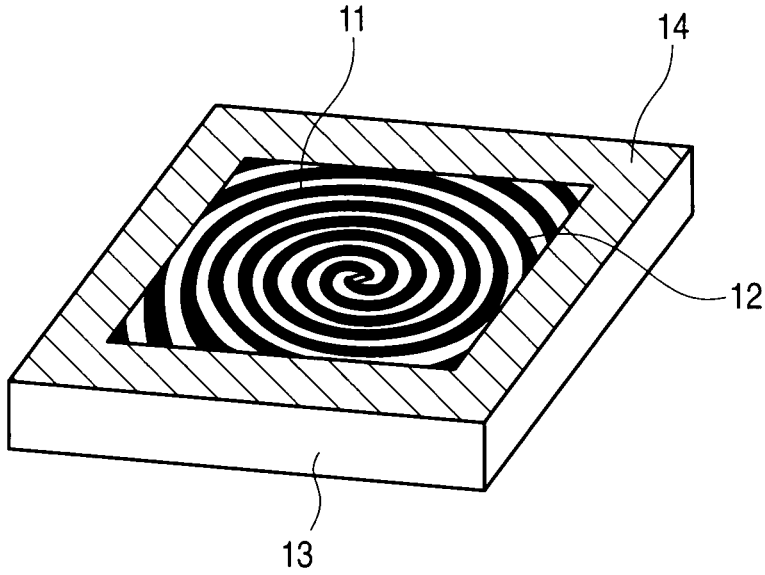
FIG. 11 is a perspective view showing an antenna structure when the radio wave absorber has a polygonal shape.

Also, in the above embodiment, the circular antenna element has the two arms, and the feeding point in the center. As shown in FIG. 7, however, it is also possible to form a single-arm spiral antenna. As shown in FIGS. 8 and 9, the shape of the inner periphery of the radio wave absorber 14 may be a polygonal shape or wavy shape. Furthermore, the radio wave absorber 14 has a ring-like shape in the above embodiment. However, as shown in FIG. 10, radio wave absorbers may be arranged in portions of the periphery so as to cover only the terminal end portions of the spiral arms of the antenna element 11. As shown in FIG. 11, it is also possible to combine an antenna device having a polygonal shape such as a square with a circular spiral antenna.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A spiral antenna comprising:

an antenna element formed into a spiral shape on a dielectric substrate;

a cavity formed to have a space with the antenna element; and a radio wave absorber placed on an upper surface of the dielectric substrate to cover a terminal end portion of the spiral.

2. The antenna according to claim 1, wherein the radio wave absorber is formed into a ring shape.

3. The antenna according to claim 1, wherein the spiral shape of the antenna element is one of a circle and a polygon.

4. The antenna according to claim 1, wherein the radio wave absorber is formed to have one of a polygonal shape and a wavy shape near a center of the spiral.

* * * * *